US012708211B2

(12) United States Patent
Kirk

(10) Patent No.: US 12,708,211 B2
(45) Date of Patent: Aug. 18, 2026

(54) TRAVEL AND OUTDOOR PILLOWS

(71) Applicant: Brian Thomas Kirk, Atlanta, GA (US)

(72) Inventor: Brian Thomas Kirk, Atlanta, GA (US)

(73) Assignee: Ballast Outdoor Gear LLC., Atlanta, GA (US)

( * ) Notice: Subject to any disclaimer, the term of this patent is extended or adjusted under 35 U.S.C. 154(b) by 0 days.

(21) Appl. No.: 18/674,881

(22) Filed: May 26, 2024

(65) Prior Publication Data

US 2024/0389754 A1 Nov. 28, 2024

Related U.S. Application Data

(60) Provisional application No. 63/469,361, filed on May 26, 2023.

(51) Int. Cl.
*A47C 7/38* (2006.01)
*A47G 9/10* (2006.01)

(52) U.S. Cl.
CPC ..... *A47C 7/383* (2013.01); *A47G 9/1027* (2013.01)

(58) Field of Classification Search
CPC ..... A47C 7/383; A47G 9/1027
See application file for complete search history.

(56) References Cited

U.S. PATENT DOCUMENTS

| | | | | |
|---|---|---|---|---|
| 6,745,418 | B1 | 6/2004 | Turner, Jr. | |
| 8,468,628 | B1 | 6/2013 | Cheng | |
| 8,850,641 | B2 * | 10/2014 | Marbury, III | A47G 9/1054 5/643 |
| 10,085,575 | B2 | 10/2018 | Vogel | |
| 2003/0028971 | A1 * | 2/2003 | Chaffee | A47G 9/062 5/710 |
| 2021/0282576 | A1 * | 9/2021 | Kirk | A47G 9/1036 |

* cited by examiner

*Primary Examiner* — J. T. Newton
(74) *Attorney, Agent, or Firm* — GREENBERG TRAURIG LLP; Trenton A. Ward

(57) ABSTRACT

Embodiments of present disclosure provide a pillow. One embodiment provides a pillow including a u-shaped main body comprising a left portion, a right portion, and an upper portion and an aperture is provided between the left portion, the right portion, and the upper portion. Furthermore, the embodiment of the pillow includes an inflatable air bladder inside the u-shaped main body. In this embodiment, the pillow also includes a left pillar on the bottom of the left portion, a right pillar on the bottom of the right portion, and an upper pillar on the bottom of the upper portion, and an air channel is provided between the upper pillar and the left pillar and the right pillar. In this embodiment, a face of a user can be inserted into the aperture and a nose and a mouth of the user can rest in the air channel above a resting surface upon which the pillow is placed.

14 Claims, 5 Drawing Sheets

TRAVEL AND OUTDOOR PILLOWS

TECHNICAL FIELD

The present disclosure relates generally to pillows, including improved travel and outdoor pillows.

BACKGROUND

Pillows designed to accommodate a combination of outdoor relaxation, sunbathing, and travel are virtually nonexistent. Most existing neck pillows designed for travel are made with absorbent fabrics, and filled with padding, that are not conducive to typical outdoor sunbathing environments where the pillows will be subjected to sand, water, suntan oils, and sweat. Moreover, when sunbathing on one's stomach, many people desire a hole in the pillow that will cradle one's face, similar to the pillow on a massage table. Existing u-shaped pillows with face holes lack proper ventilation when lying face-down on a hot day. Nor can existing u-shaped pillows be comfortably enjoyed while lying in the faceup position, as the hole meant for the face lacks support for the back of the head. Most existing u-shaped travel pillows are filled with padding and cannot be collapsed to a smaller size, making them cumbersome to bring to typical sunbathing locations, such as the beach or pool. And inflatable u-shaped pillows, which are easier to travel with, are too lightweight for beaches, or other outdoor environments, where a gust of wind can easily blow the inflatable pillow away.

Prior art has described pillows designed to be used when lying face-down. U.S. Pat. No. 6,745,418 describes an inflatable pillow with an annular bore for receiving the face of the user, with the body member having a plurality of ventilating bores to permit unimpeded breathing. There are several disadvantages associated with this invention. For example, there is no way to keep the lightweight inflatable structure from blowing away on a windy day, particularly at the beach where coastal winds are common. Additionally, the ventilating bores intended to facilitate breathing do not provide sufficient means of ventilation to produce a cooling effect for the user on a hot day. Furthermore, this pillow lacks support for the back of one's head should one want to lie on one's back and cannot be worn around the neck while sitting upright.

Another type of face-down pillow is U.S. Pat. No. 8,468,628, which describes a pillow containing an opening for a person's face as well as side openings that enable a person to breathe. The device also contains a fan which can blow air into the cavity of the pillow. However, several disadvantages are associated with this invention. For example, the structure is solid with a padded cushion and therefore cannot be consolidated to a compact size for easy transportation to various outdoor locations, such as the beach. Furthermore, because the ventilation bores designed to facilitate breathing are not large enough to produce a cooling effect for the user on a hot day, the pillow contains a motorized fan to produce cooling air which requires batteries to operate and could be difficult to repair should it stop working. This invention does not provide support for the back of one's head when lying face-up and cannot be worn around one's neck.

U.S. Pat. No. 10,085,575 describes another pillow with a u-shape hole designed to be used in multiple positions, lying face-down, lying face-up, and sitting upright. The pillow features a two-piece design comprised of an upper wedged contour pillow and a lower horseshoe pillow that can be used together in various configurations to accommodate multiple lying or sitting positions. The horseshoe section of the pillow may include channel-like openings to allow for easier breathing when lying in a prone position. This pillow contains several disadvantages. For example, the structure is solid and comprised of multiple pieces, which prevent it from collapsing down to a compact size that can easily fit inside a small travel bag for easy transportation. The preferred cushion material is described as foam, which is not optimal for use in wet environments, such as the pool or beach, where the foam material could become waterlogged. While the possible channel-like openings facilitate breathing, they would not be large enough to produce sufficient ventilation to provide a cooling effect on a hot day. Furthermore, these tubes would be prone to the accumulation of dirt, debris, and mold caused by moisture from expelled breath and outside humidity.

Due to the disadvantages of current pillows, a need exists for a new and improved pillow that can be used in multiple positions, including lying face-down, lying face-up, and sitting upright, that provides an abundance of airflow when lying face-down without using constricted air apertures that can accumulate moisture and debris, that provides a supportive surface for the back of the head when lying faceup, that will not be blown away by the wind, and that can collapse into a removably attachable carrying case for easy transportation.

SUMMARY

Embodiments of present disclosure provide a pillow. One embodiment provides a pillow including a u-shaped main body comprising a left portion, a right portion, and an upper portion, and an aperture is provided between the left portion, the right portion, and the upper portion. Furthermore, the embodiment of the pillow includes an inflatable air bladder inside the u-shaped main body. In this embodiment, the pillow also includes a left pillar on the bottom of the left portion, a right pillar on the bottom of the right portion, and an upper pillar on the bottom of the upper portion, and an air channel is provided between the upper pillar and the left pillar and the right pillar. In this embodiment, a face of a user can be inserted into the aperture and a nose and a mouth of the user can rest in the air channel above a resting surface upon which the pillow is placed.

Both the foregoing general description and the following detailed description are exemplary and explanatory only and are not restrictive of the examples, as claimed.

Figure 1:
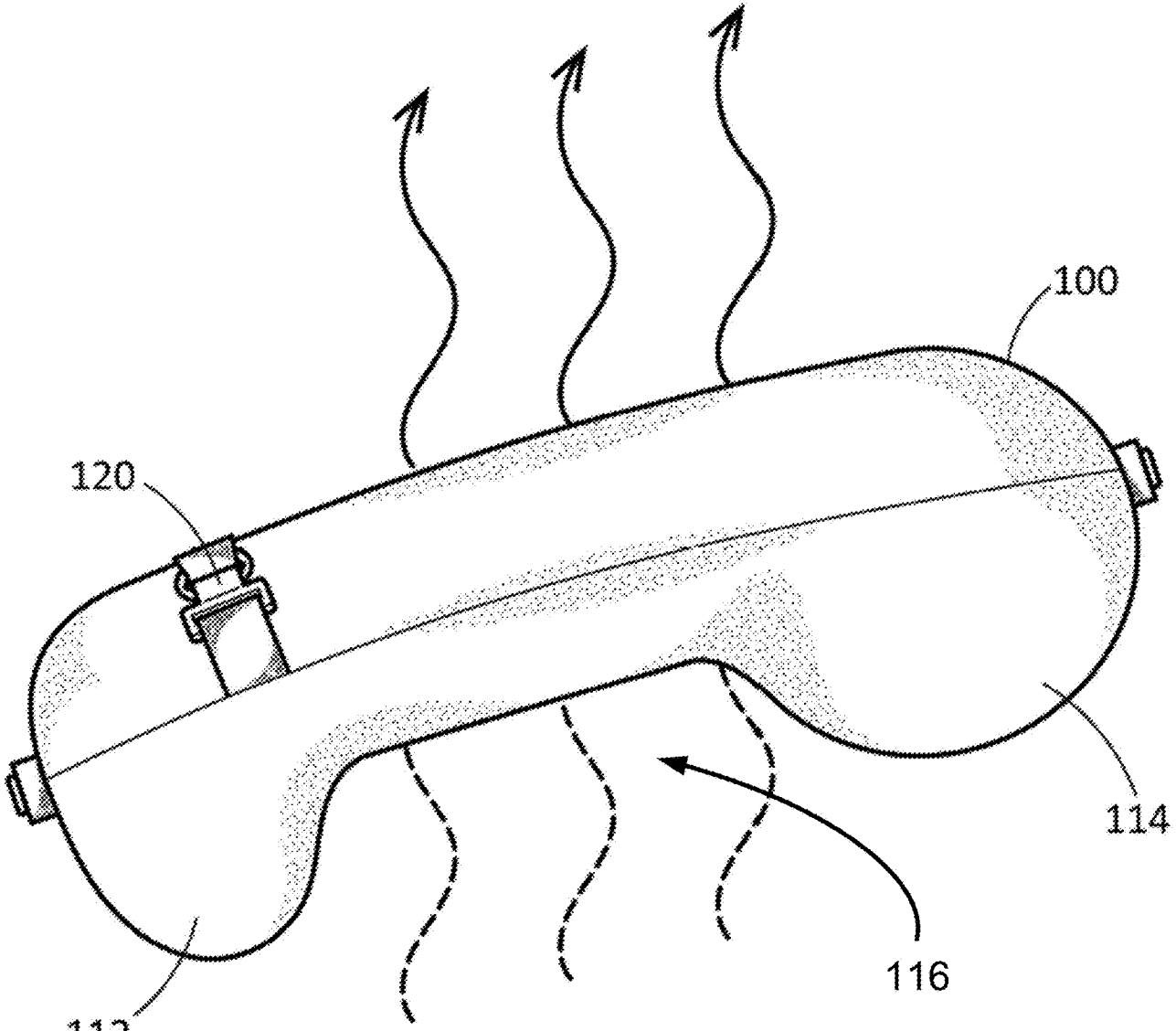
FIG. 1 is an illustration of a profile view of pillow 100 in accordance with some embodiments of the present disclosure.

Throughout the drawings, identical reference characters and descriptions indicate similar, but not necessarily identical, elements. While the example implementations described herein are susceptible to various modifications and alternative forms, specific implementations have been shown by way of example in the drawings and will be described in detail herein. However, the example implementations described herein are not intended to be limited to the particular forms disclosed. Rather, the present disclosure covers all modifications, equivalents, and alternatives falling within the scope of the appended claims.

DETAILED DESCRIPTION

Embodiments of the present disclosure relate to pillows, such as travel pillows, outdoor pillows, and combinations thereof. Although certain embodiments of the disclosed technology are explained in detail, it is to be understood that other embodiments are contemplated. Accordingly, it is not intended that the disclosed technology is limited in its scope to the details of construction and arrangement of components set forth in the following description or illustrated in the drawings. The disclosed technology is capable of other embodiments and of being practiced or carried out in various ways. Also, in describing the preferred embodiments, specific terminology will be resorted to for the sake of clarity.

It should also be noted that, as used in the specification and the appended claims, the singular forms "a," "an" and "the" include plural references unless the context clearly dictates otherwise. References to a composition containing "a" constituent is intended to include other constituents in addition to the one named.

Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, for example, similar components that are developed after development of the presently disclosed subject matter.

To facilitate an understanding of the principles and features of the disclosed technology, various illustrative embodiments are explained below. In particular, the presently disclosed subject matter is described in the context of pillow. The present disclosure, however, is not so limited, and can be applicable in other contexts. These embodiments are contemplated within the scope of the present disclosure.

Reference will now be made in detail to the present embodiments, including embodiments illustrated in the accompanying drawings. Wherever possible, the same reference numbers will be used throughout the drawings to refer to the same or like parts.

In accordance with some embodiments of the present disclosure, an improved pillow is provided that can be comprised of multiple panels. Furthermore, in some embodiments the pillow is configured in a u-shape, which flexibly allows the pillow to operate in multiple configurations, including 1) when a user has the user's face inserted into an aperture in the pillow, 2) when a user's head is lying on the pillow, and 3) when the pillow is worn around the user's neck. In some embodiments, the pillow can include a removably attachable pouch. In these embodiments, the pouch can be removably attached at different locations on the pillow to accommodate different configurations for the pillow, including (1) when the pouch is collapsed to the pillow or removed completely when the user has the user's face inserted into an aperture in the pillow or when the pillow is worn around the user's neck, (2) when the pouch is extended to at least partially cover the aperture in the pillow when a user's head is lying on the pillow, and (3) when the pouch is removably attached to the pillow and configured with weighted objects that prevent the pillow from being moved by the wind or other forces. In some embodiments, the pillow can include a compartment where the pouch can be stored when not in use.

FIG. 1 is an illustration of a profile view of pillow 100 in accordance with some embodiments of the present disclosure. In the embodiment depicted in FIG. 1, the pillow 100 includes pillars 112 and 114 on the bottom side of the pillow 100. In the embodiment shown in FIG. 1, pillars 112 are configured proximate the bottom of the pillow on opposite sides of the u-shape opening of the pillow. Furthermore, in the embodiment shown in FIG. 1, pillar 114 is configured proximate the top of the pillow. In accordance with some embodiments of the present disclosure, the pillars 112 and 114 can be configured to cause the pillow 100 to be propped up or raised relative to a surface upon which the pillow 100 is resting. Accordingly, in accordance with some embodiments of the present disclosure, the pillars 112 and 114 create an air channel 116 on the bottom side of the pillow 100. Those of skill in the art will appreciate that the air channel 116 provided by some embodiments of pillow 100 can provide numerous benefits to a user, including allowing air to flow freely beneath the pillow and between the aperture in the pillow 100 when the user has the user's face inserted into a portion of the aperture. For example, in some embodiments, the pillow 100 can be configured on a towel placed on the sand of a beach and the user can lay face-down on the pillow 100 with their face inserted into the u-shaped aperture of the pillow 100. In this configuration, the air channel 116 can enable the flow of air to the user's face and neck and also keep the user's face elevated above the towel so as to not require the user's face to contact the towel. In accordance with some embodiments of the present disclosure, the pillars 112 and 114 and air channel 116 create a comfortable position for the user to relax while in face-down position on a towel, the beach, a sofa, grass, or on the ground generally.

The shape can be maintained by an inner air bladder comprised of plastic, rubber, resin, or any water-resistant and airtight material. The inner air bladder can be molded into a unique shape that creates support pillars 114 in the rear and support pillars 112 in the front of the pillow, producing an unobstructed channel for airflow without the need for additional apertures or extra components. In addition to creating a channel for air to flow through, the support pillars 112, 114 raise the pillow 100 off the ground so that the user's face does not come in contact with the ground. The pillars 112, 114 also help to align the user's head and spine in a comfortable straight line. In some embodiments, pillars 112 and 114 can also provide added head support when sitting upright and wearing the pillow 100 round one's neck. Those of skill in the art will appreciate that pillars 112 and 114 can be of varying sizes such that a predetermined angle for a resting head is created when the pillow 100 is placed upon a surface.

As shown in the embodiment depicted in FIG. 1, the pillow can include a first attachment member 120, such as a clasp, snap buttons, hook and loop fasteners, buckles, and other suitable attachment members. In accordance with some embodiments of the present disclosure, the first attachment member 120 can be on the top side of the pillow 100 and positioned proximate the bottom of the pillow on each side of the u-shaped configuration. In accordance with some embodiments of the present disclosure, the first attachment member can be used to secure the removably attachable pouch to the pillow 100.

Figure 2:
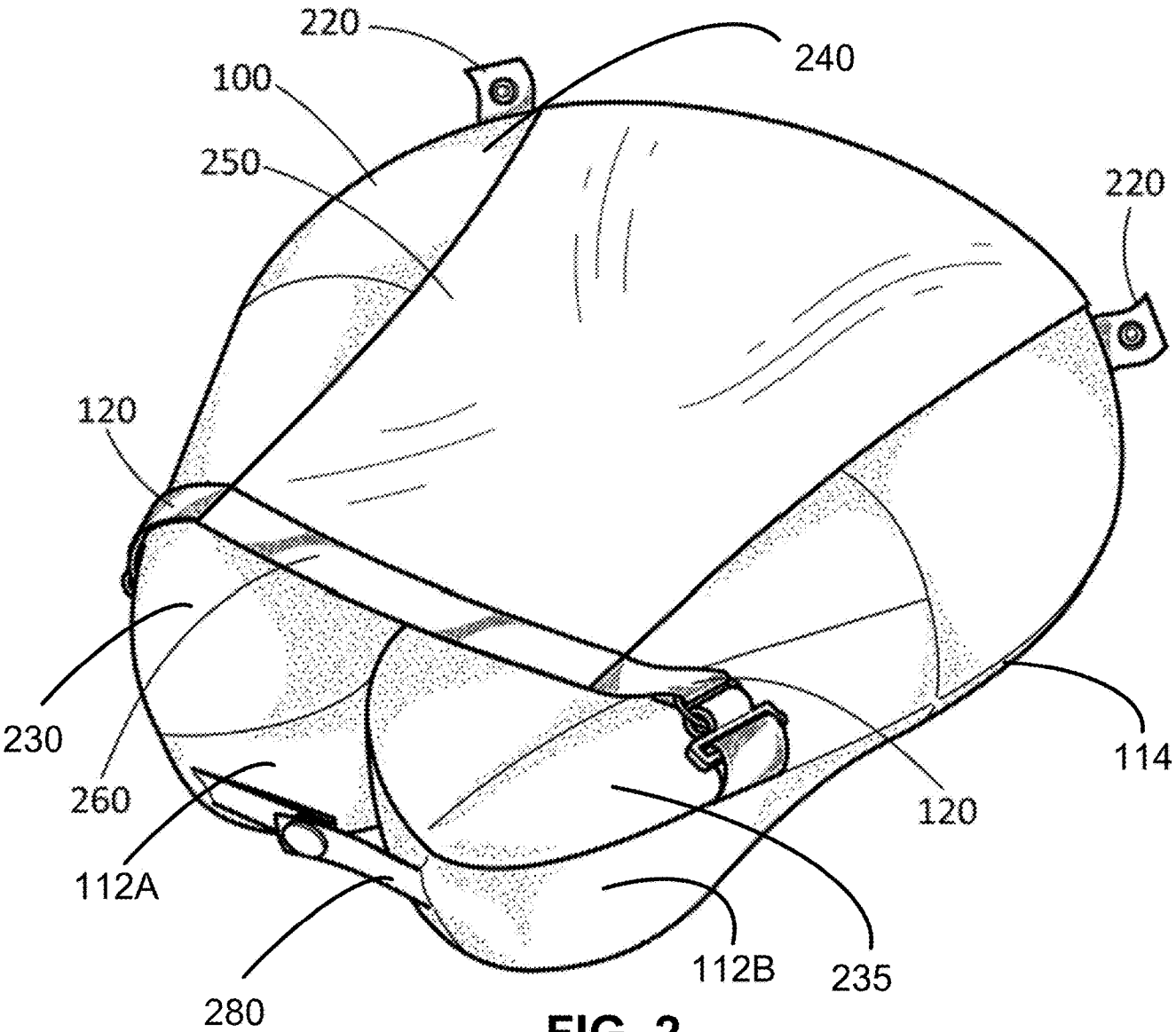
FIG. 2 is an illustration of a perspective view of pillow 100 in accordance with some embodiments of the present disclosure.

FIG. 2 is an illustration of a perspective view of pillow 100 in accordance with some embodiments of the present disclosure. In accordance with some embodiments of the present disclosure, the pillow 100 provides a u-shaped main body. The u-shaped main body of the pillow 100 in the embodiment depicted in FIG. 2 has a left portion 230, a right portion 235, and an upper portion 240. In accordance with some embodiments of the present disclosure, the pillow 100 includes an inflatable air bladder configured inside the main body that can be used to inflate and deflate the pillow 100. Furthermore, in the embodiment show in FIG. 2 the left portion 230 has a left pillar 112A on the bottom of the left portion 230, the right portion 235 has a right pillar 112B on the bottom of the right portion 235, and the upper portion 240 has an upper pillar 114 on the bottom of the upper portion 240. As shown in the embodiment in FIG. 2, an aperture is provided between the left portion, the right portion, and the upper portion of the pillow 100 when the pillow is inflated. In the embodiment shown in FIG. 2, the aperture is at least partially covered by the removably attachable pouch 250. In accordance with some embodiments of the present disclosure, the user's head can be rested on the removably attachable pouch 250 when it is configured to at least partially cover the aperture. Alternatively, the aperture can remain uncovered in some embodiments, and is configured to allow the user to insert the user's face into the aperture and for the head of the user to rest on the left portion 230, a right portion 235, and an upper portion 240 of the u-shaped main body. As shown in both FIGS. 1 and 2, in some embodiments of the present disclosure, an air channel 116 is provided between the left pillar 112A, the right pillar 112B, and upper pillar 114. In accordance with some embodiments of the present disclosure, the pillow 100 can be configured to allow the nose and the mouth of the user to be maintained in the air channel 116 above a resting surface upon which the pillow 100 is placed. For example, when the pillow 100 is placed on a resting surface (i.e., the surface upon which the pillow is lying), the user can lie down on the pillow 100 and insert the user's face into the aperture and the user will be able to breathe easily, as the user's nose and mouth will be elevated above the resting surface and can breathe air provided in the air channel 116. Furthermore, in this example, when the user rests face-down on the pillow 100 and inserts the user's face into the aperture, the user's face comes to rest above the surface for pillow 100 such that the user can comfortably rest without their face being in contact with the resting surface. Those of skill in the art will appreciate that some embodiments of the present disclosure allow the user to comfortably lay face-down on the pillow 100 on the beach, ground, or other resting surface without the user's face contacting the beach, ground, or other resting surface. Furthermore, some embodiments of the present invention allow the user to easily breathe through the air channel 116 provided between the left pillar 112A, the right pillar 112B, and upper pillar 114 when the user is lying face-down on the pillow 100.

In the embodiment depicted in FIG. 2, pillow 100 includes a removably attachable pouch 250. As shown in the embodiment in FIG. 2, the removably attachable pouch 250 can be attached to the top of the pillow 100 and extended to at least partially cover the aperture formed in the u-shaped main body of pillow 100. Those of skill in the art will appreciate that the removably attachable pouch 250 can be attached to the pillow with a number of suitable attachment techniques and mechanisms, including latches, clasps, snap buttons, hook and loop fasteners, magnets, buckles, and other suitable attachment mechanisms.

As shown in the embodiment in FIG. 2, removably attachable pouch 250 can be coupled to both of the first attachment members 120 on the top side of the bottom of the pillow 100 on opposing sides of the u-shaped main body of the pillow 100. In accordance with some embodiments of the present disclosure, the configuration of the removably attachable pouch 250 to at least partially cover the aperture of the pillow 100 allows for a comfortable and relaxing location on which the user can rest a portion of their head. For example, the user can lay on the pillow 100 with the back of their head resting on removably attachable pouch 250 of pillow, thereby lying face-up, and be fully supported and comforted by the pillow. In some embodiments removably attachable pouch 250 can emulate a hammock type configuration extending over a portion of the aperture of the u-shaped main body of pillow 100 to provide comfort for the resting head of a user.

As shown in the embodiment in FIG. 2, the pillow 100 can include a fastening mechanism 280 to secure the left portion 230 and the right portion 235 of the u-shaped main body a desired distance from each other. Those of skill in the art will appreciate that the fastening mechanism 280 can be latches, clasps, snap buttons, hook and loop fasteners, magnets, buckles, and other suitable fastening devices. In accordance with some embodiments of the present disclosure, the fastening mechanism 280 can help improve the comfort of the user by keeping the left portion 230 and the right portion 235 a desired distance from each other. For example, in one embodiment, when the user inserts the user's face into the aperture and lies face-down on the pillow 100, the fastening mechanism 280 can keep the left portion 230 a desired distance from and the right portion 235, thereby provided further support for the user's face, neck, and chest, while lying face-down on the pillow 100.

In some alternative embodiments, the pouch 250 of the pillow is not a removably attachable pouch but rather permanently attached at one more attachment points on the pillow 100. For example, in one embodiment, the pouch 250 can be permanently sown on one end to the upper portion of the u-shaped main body of the pillow. Although in this embodiment the pouch 250 is permanently attached to the upper portion 240, the pouch 250 can be configured to be removably attached to the left portion 230 and the right portion 235 of the u-shaped main body of pillow 100. In this embodiment, the pouch 250 is permanently attached to the upper portion 240 and can be connected to the left portion 230 and the right portion 235 to at least partially cover the aperture when face-up lying is desired by user and can be configured to be condensed and attached to the upper portion 240 when face-down lying is desired by the user with an open aperture.

In some embodiments, the pillow 100 can feature an inflatable bladder encased in a water/sand repellant fabric and incorporate a removably attachable pouch 250 that can attach to the pillow at multiple points. In accordance with some embodiments of the present disclosure, the removably attachable pouch 250 can be filled with weighted materials. For example, in the embodiment shown in FIG. 2, the removably attachable pouch 250 can include an opening 260 configured to permit weighted materials, such as sand, keys, or a phone, to be placed inside removably attachable pouch 250. Additionally, in accordance with some embodiments of the present disclosure, the removably attachable pouch 250 can also serve as the carrying case for the pillow. For example, in some embodiments, the opening 260 of the removably attachable pouch 250 can be configured to accommodate the insertion of the deflated pillow 100 and can include a closing mechanism to prevent its contents from spilling out during movement.

In accordance with some embodiments of the present disclosure, the pillow 100 can also provide fastening mechanisms to enable the removably attachable pouch 250 to be secured to the top side of the pillow 100. As shown in the embodiment depicted in FIG. 2, the pillow 100 can provide fastening members 220 on opposing sides of the removably attachable pouch 250, which are configured to secure the rolled-up removably attachable pouch 250 to the top of the pillow; thereby, providing a simple and intuitive fastening system for securing the removably attachable pouch 250 tightly to the pillow, so as to create a single, integrated object. As shown in FIG. 2, fastening members 220 can provide clasps that fasten to mating clasps on the removably attachable pouch 250. Those of skill in the art will appreciate that in addition to clasps, the fastening members 220 can also be latches, clasps, snap buttons, hook and loop fasteners, magnets, buckles, and other suitable fastening devices. As shown in the embodiment depicted in FIG. 2, fastening members 220 can be utilized for securing the removably attachable pouch 250 in a manner that leaves the aperture in the pillow unobstructed.

In another embodiment, the removably attachable pouch 250 can be configured to accommodate a cooling gel pack or heating gel pack. Those of skill in the art will appreciate that a variety of sizes and shapes of cooling gel packs and heating gel packs are available. In accordance with some embodiments of the present disclosure, the removably attachable pouch 250 provides a pocket for receiving cooling gel packs and/or heating gel packs of a general size.

In accordance with some embodiments of the present disclosure, the pillow 100 can comprise a u-shaped main body that is approximately 13"×13" in size. In some embodiments, the pillow 100 includes an internal air bladder configured inside the u-shaped main body made of flexible air-tight material, such as plastic or rubber, covered in a soft fabric, such as a polyester or microfiber fabric. In some embodiments, the fabric that covers the outside of the pillow 100 can be a fabric that wicks away water and sheds sand. Additionally, in accordance with some embodiments of the present disclosure, the fabric cover of the pillow 100 can be removed in order to be washed. Furthermore, in accordance with some embodiments of the present disclosure, the removably attachable pouch 250 can be made of polyester, nylon, or similar slick and durable material. Furthermore, in some embodiments, the removably attachable pouch 250 can be attached to the back of the pillow 100.

In accordance with some embodiments of the present disclosure, the user can place sand into the removably attachable pouch 250, or the removably attachable pouch 250 can be filled with other weighted objects that prevent the pillow from being moved by the wind or other forces. The opening 260 in the removably attachable pouch 250 is configured in some embodiments to allow the removably attachable pouch 250 to be at least partially filled with sand without the user having to contact the sand directly, or, in other words, without the user's hand touching the sand. In accordance with some embodiments of the present disclosure, the opening 260 in the removably attachable pouch 250 can be lined with plastic bands or magnetized tape, which are sufficiently rigid to dig into sand so that the removably attachable pouch 250 can be used to scoop up sand without using one's hand, shovels, or additional devices. Additionally, in some embodiments, the opening 260 of the removably attachable pouch 250 can comprise a closing mechanism, such as magnetic bands, a zipper, interlocking grooves, or the like, that prevent sand, or other objects enclosed in the removably attachable pouch 250, from spilling out. In some embodiments, the removably attachable pouch 250 can be attached to the pillow 100 with elastic bands that are looped around hooked clasps affixed to the side edges of the pillow, resulting in a unified structure. Alternatively, in other embodiments the removably attachable pouch 250 can be attached to the pillow 100 with snap buttons, hook and loop fasteners, magnets, buckles, latches, and other suitable attachment mechanisms.

Those of skill in the art will appreciate that there are variety of suitable techniques that can be used to inflate and deflate various embodiments of the pillow 100. For example, in one embodiment, the pillow 100 can be inflated using an air valve that can fully inflate the pillow 100. In some embodiments, the pillow can be inflated by the exhalations of the user, such as three exhalations by the user. In some embodiments, the air valve can have multiple settings to manage the flow of air. In the default setting of one embodiment, air is trapped inside the air bladder by the air valve and can be manually deflated by pushing a button in the center of the valve, allowing the user to incrementally adjust the amount of air inside the air bladder for optimal comfort. In this embodiment, when a button on the air value is turned, such as turned 90 degrees clockwise, the air valve can release all of the air within the internal air bladder of the pillow 100. Accordingly, in some embodiments, the air bladder of the pillow 100 can be fully deflated and conveniently stored inside the removably attachable pouch 250.

Thereby, in some embodiments, the removably attachable pouch 250 can convert into a compact carrying case for the deflated pillow 100.

Figure 3:
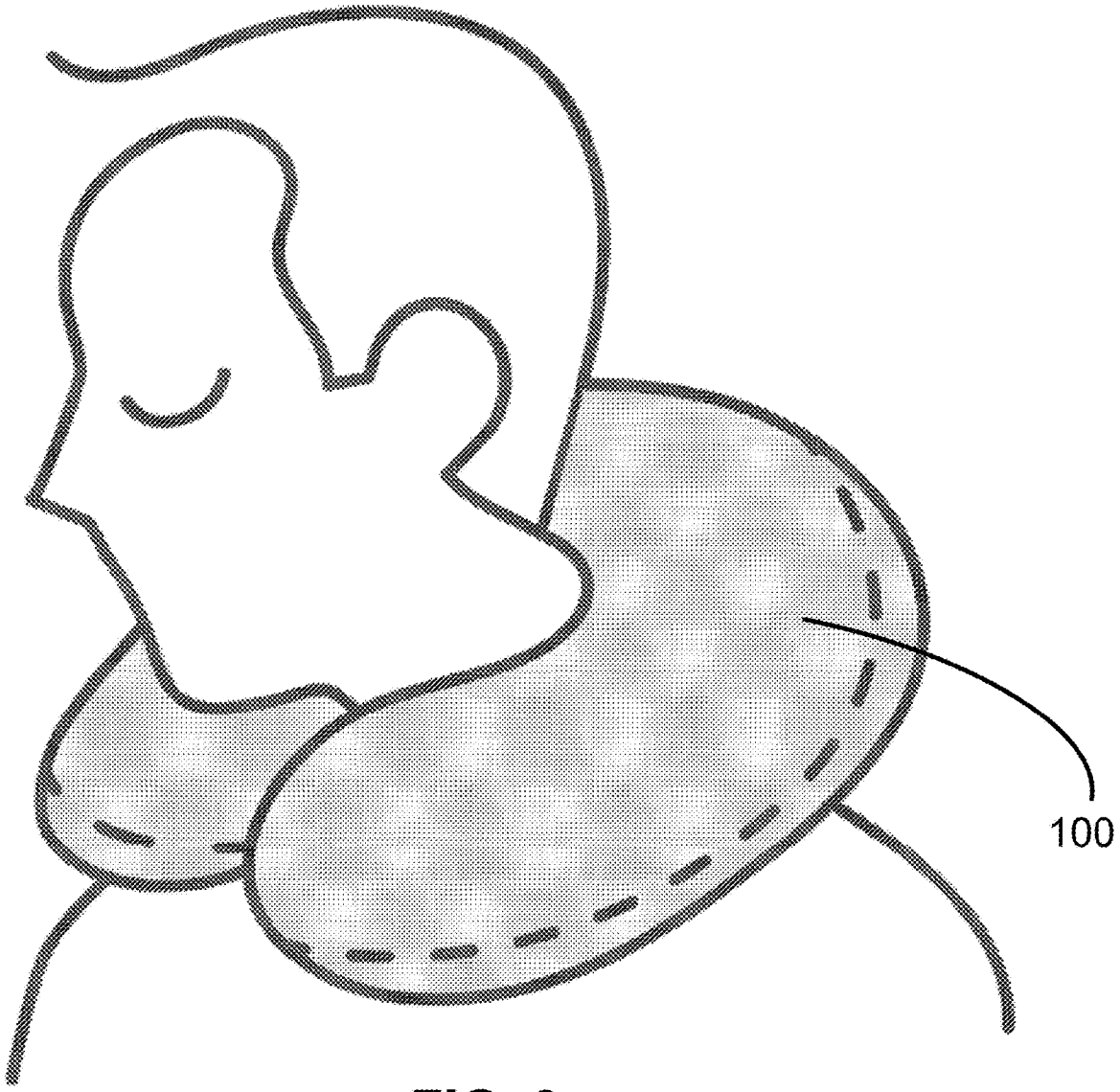
FIG. 3 is an example illustration of a perspective view of an embodiment of the pillow 100 configured for wearing around a user's neck.

FIG. 3 is an example illustration of a perspective view of an embodiment of the pillow 100 configured for wearing around a user's neck. In this embodiment, the pillow 100 can be deployed by the user for comfort when traveling, when resting at home or at work, or generally when relaxing head and neck support is desired by the user. Accordingly, the user can wear the pillow 100 around the user's neck during car rides or airplane flights. Additionally, in some embodiments the pillars on the bottom side of the pillow 100 can be arrange to allow the user to turn the pillow 100 sideways to position the back pillar on the user's shoulder for extra support. Those of skill in the art will appreciate that different configurations of the pillars of various embodiments of the pillow 100 can be configured or arranged for user comfort while using the pillow 100.

Figure 4:
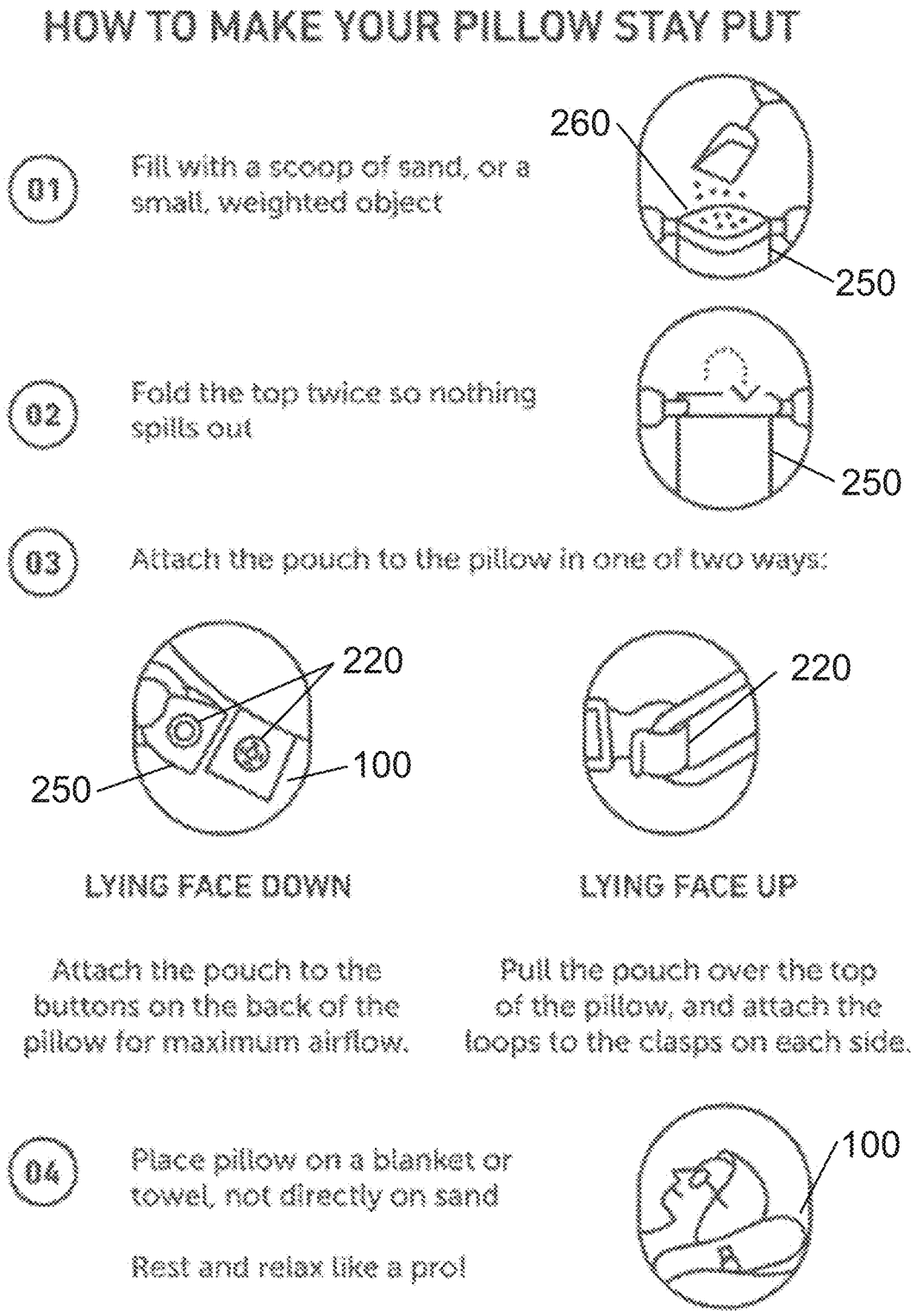
FIG. 4 is a flow chart of a method for configuring an embodiment of the pillow 100 for use in varying configurations.

FIG. 4 is a flow chart of a method for configuring an embodiment of the pillow 100 for use in varying configurations. At step 1, the removably attachable pouch 250 of the pillow 100 can be filled with sand or some other weighted object(s). For example, in some embodiments of the removably attachable pouch 250, the opening 260 can be pressed open and the objects placed inside removably attachable pouch 250. At step 2, opening 260 of removably attachable pouch 250 can be folded multiple times to keep the contents from spilling out of the removably attachable pouch 250. At step 3, the removably attachable pouch 250 of an embodiment of pillow 100 can be attached to the pillow 100 in one of at least two ways. For configurations in which the user's face is inserted into the aperture 270 of an embodiment of the pillow 100, the removably attachable pouch 250 can be secured to the top of pillow 100 by fastening members 220 after the removably attachable pouch 250 has been rolled up. Those of skill in the art will appreciate that the fastening members 220 can be snaps, buttons, latches, hook and loop fasteners, or other attachment types. In the illustrated example, the second attachment points 220 are snaps. In accordance with some embodiments of the present disclosure, placing the removably attachable pouch 250 in condensed and stored configuration can improve the airflow through the air channel 116 provided by some embodiments of the pillow 100. Alternatively, in another configuration of an embodiment of the pillow 100, the removably attachable pouch 250 can be attached to the first attachment members 120, such that the removably attachable pouch 250 can be pulled over a portion of the aperture 270 in the pillow and attached to the first attachment members 120. At step 4, an embodiment of the pillow 100 can be placed on the ground, a blanket, or other surface.

Figure 5:
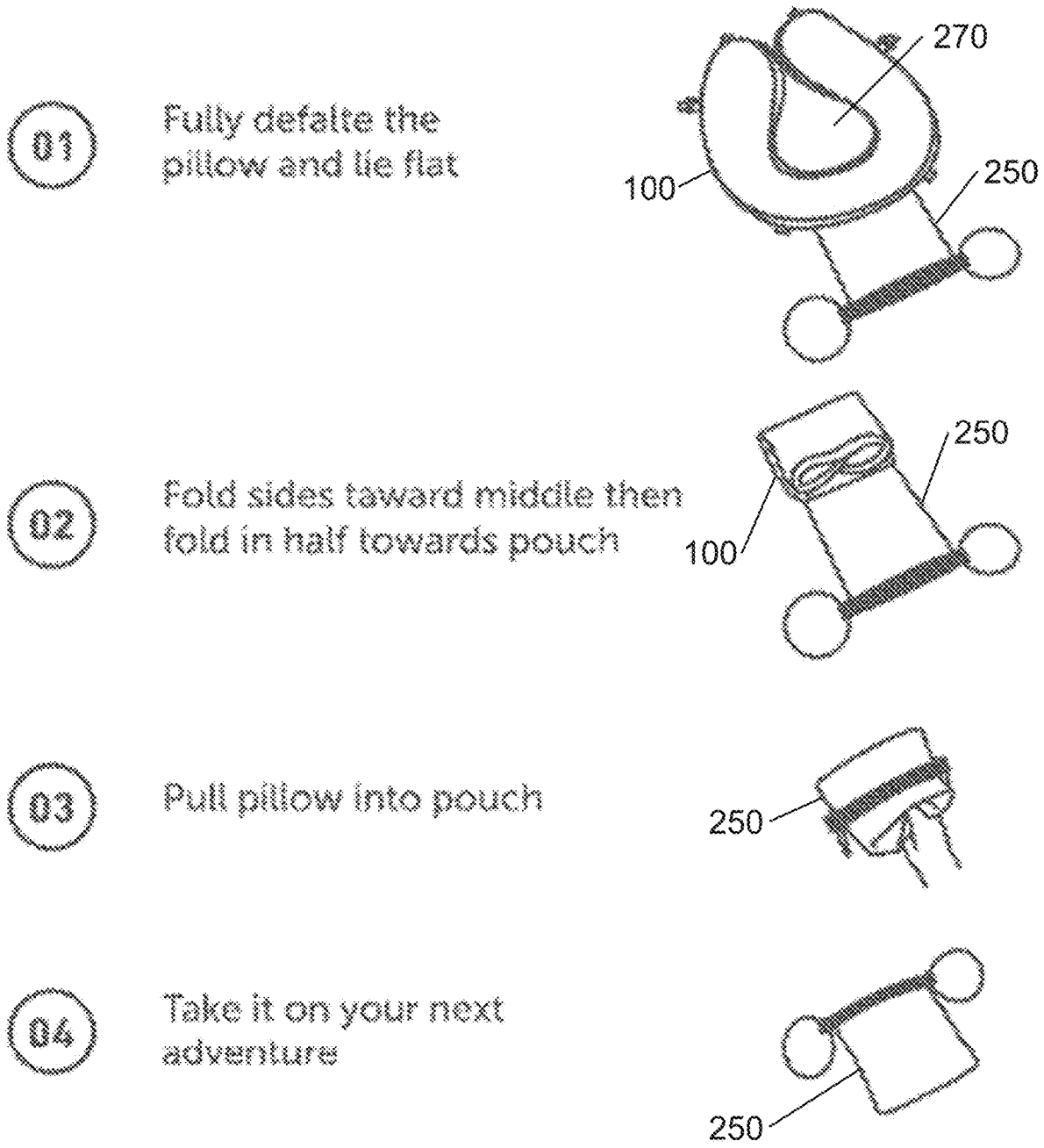
FIG. 5 is a flow chart of a method for configuring an embodiment of the pillow 100 to be stored in the removably attachable pouch 250.

FIG. 5 is a flow chart of a method for configuring an embodiment of the pillow 100 to be stored in the removably attachable pouch 250. At step 1, an embodiment of the pillow 100 can be deflated. At step 2, the sides of an embodiment of the pillow 100 can be folded towards the middle and then folded in half towards the removably attachable pouch 250. At step 3, an embodiment of the pillow 100 can be inserted into the removably attachable pouch 250. Those of skill in the art will appreciate that the removably attachable pouch 250 can be used to store the pillow 100 whether the removably attachable pouch 250 is attached to the pillow 100 or separate from the pillow 100.

Other examples of the disclosure will be apparent to those skilled in the art from consideration of the specification and practice of the examples disclosed herein. Though some of the described methods have been presented as a series of steps, it should be appreciated that one or more steps can occur simultaneously, in an overlapping fashion, or in a different order. The order of steps presented are only illustrative of the possibilities and those steps can be executed or performed in any suitable fashion. Moreover, the various features of the examples described here are not mutually exclusive. Rather, any feature of any example described here can be incorporated into any other suitable example. It is intended that the specification and examples be considered as exemplary only, with a true scope and spirit of the disclosure being indicated by the following claims.

While the invention has been disclosed in exemplary forms, it will be apparent to those skilled in the art that many modifications, additions, and deletions can be made without departing from the spirit and scope of the invention and its equivalents, as set forth in the following claims.

What is claimed is:

1. A pillow, comprising:

a u-shaped main body comprising:

a left portion, a right portion, and an upper portion of the u-shaped main body;

wherein an aperture is provided between the left portion, the right portion, and the upper portion;

an inflatable air bladder inside the u-shaped main body;

a left pillar on the bottom of the left portion, a right pillar on the bottom of the right portion, and an upper pillar on the bottom of the upper portion, wherein an air channel is provided between the upper pillar and the left pillar and the right pillar;

wherein the aperture is configured to receive a face of a user and the air channel is configured to receive a nose and a mouth of the user, wherein the air channel is above a resting surface upon which the pillow is placed; and a removably attachable pouch, the removably attachable pouch being removably attachable at three attachment locations respectively on the upper portion, the left portion, and the right portion of the u-shaped main body via fasteners such that, when attached, the removably attachable pouch at least partially spans and covers the air channel when the face of the user is in the aperture, wherein the removably attachable pouch is configured to store the pillow when the inflatable air bladder is deflated.

2. The pillow of claim 1, wherein the removably attachable pouch is configured to hold weighted material.

3. The pillow of claim 2, wherein the removably attachable pouch is attached to the u-shaped main body, holds weighted material, and extends from a side of the u-shaped main body to deter movement of the pillow.

4. The pillow of claim 1, wherein the removably attachable pouch can be attached with a clasp on the left portion of the u-shaped main body and a clasp on the right portion of the u-shaped main body.

5. The pillow of claim 1, wherein the removably attachable pouch is configured for the user to rest the user's head when it is configured to at least partially cover the aperture of the u-shaped main body.

6. The pillow of claim 1, wherein the removably attachable pouch is configured to be condensed and attached to the upper portion of the u-shaped main body such that the removably attachable pouch does not cover the aperture.

7. The pillow of claim 6, wherein the removably attachable pouch can include a first snap button and second snap button which is connected to a third snap button and a fourth snap button provided on the upper portion of the u-shaped main body.

8. The pillow of claim 6, wherein the aperture is configured to receive the face of the user after the removably attachable pouch is condensed and attached to the upper portion of the u-shaped main body.

9. The pillow of claim 1, further comprising a first air valve connected to the inflatable air bladder.

10. A method of lying on a pillow, comprising:

providing the pillow having a u-shaped main body, the u-shaped main body comprising:

a left portion, a right portion, and an upper portion of the u-shaped main body;

wherein an aperture is provided between the left portion, the right portion, and the upper portion; and wherein an inflatable air bladder is provided inside the u-shaped main body;

providing a left pillar on the bottom of the left portion, a right pillar on the bottom of the right portion, and an upper pillar on the bottom of the upper portion, providing an air channel between the upper pillar and the left pillar and the right pillar;

wherein the aperture is configured to receive a face of a user and the air channel is configured to receive a nose and a mouth of the user, wherein the air channel is above a resting surface upon which the pillow is placed; and providing a removably attachable pouch, the removably attachable pouch being removably attachable at three attachment locations respectively on the upper portion, the left portion, and the right portion of the u-shaped main body via fasteners such that, when attached, the removably attachable pouch at least partially spans and covers the air channel when the face of the user is in the aperture, wherein the removably attachable pouch is configured to store the pillow when the inflatable air bladder is deflated.

11. The method of lying on a pillow of claim 10, further comprising inserting a weighted material into the removably attachable pouch to restrict the movement of the pillow.

12. The method of lying on a pillow of claim 10, further comprising configuring the removably attachable pouch to be attached to the u-shaped main body to at least partially cover the aperture of the u-shaped main body.

13. The method of lying on a pillow of claim 10, further comprising resting a head of the user on the removably attachable pouch after configuring the removably attachable pouch to at least partially cover the aperture of the u-shaped main body.

14. The method of lying on a pillow of claim 10, further comprising inserting the face of the user into the aperture.

* * * * *